US008925255B1

(12) United States Patent
Haun et al.

(10) Patent No.: US 8,925,255 B1
(45) Date of Patent: Jan. 6, 2015

(54) WALL, ROOF AND BUILDING STRUCTURES

(71) Applicant: Solarcraft, Inc., Sugar Land, TX (US)

(72) Inventors: Darrell N. Haun, Sugar Land, TX (US); Robert F. Collins, Sugar Land, TX (US); Victor F. Gingles, Sugar Land, TX (US)

(73) Assignee: Solarcraft, Inc., Sugar Land, TX (US)

( * ) Notice: Subject to any disclaimer, the term of this patent is extended or adjusted under 35 U.S.C. 154(b) by 0 days.

(21) Appl. No.: 14/261,770

(22) Filed: Apr. 25, 2014

(51) Int. Cl.

| | |
|---|---|
| ***E04B 7/02*** | (2006.01) |
| ***E04B 1/343*** | (2006.01) |
| ***E04D 13/00*** | (2006.01) |
| ***E04D 1/30*** | (2006.01) |
| ***E04F 11/022*** | (2006.01) |
| ***E04B 1/344*** | (2006.01) |

(52) U.S. Cl.
CPC ..... *E04B 1/343* (2013.01); *E04D 13/00* (2013.01); *E04D 1/30* (2013.01); *E04F 11/022* (2013.01); *E04B 1/344* (2013.01); *E04B 1/34384* (2013.01); *E04D 2001/309* (2013.01)
USPC ..... 52/91.1; 52/91.3

(58) Field of Classification Search
CPC ..... E04B 1/00
USPC ..... 52/91.1, 91.3, 79.1, 79.5
See application file for complete search history.

(56) References Cited

U.S. PATENT DOCUMENTS

| | | | | | |
|---|---|---|---|---|---|
| 817,508 | A | * | 4/1906 | Niele | 52/91.1 |
| 1,229,478 | A | * | 6/1917 | Kramer | 52/11 |
| 2,023,814 | A | * | 12/1935 | Lindsey | 52/91.3 |
| 2,365,175 | A | * | 12/1944 | Crawford | 52/643 |
| 3,009,183 | A | * | 11/1961 | Lay | 14/69.5 |
| 3,031,044 | A | * | 4/1962 | Stitt et al. | 52/508 |
| 3,657,849 | A | * | 4/1972 | Garton | 52/91.1 |
| 3,755,975 | A | * | 9/1973 | Herzer et al. | 52/90.1 |
| 4,291,510 | A | * | 9/1981 | Sivachenko | 52/91.3 |
| 5,526,628 | A | * | 6/1996 | Knudson | 52/528 |
| 6,889,475 | B2 | * | 5/2005 | De Zen | 52/91.3 |
| 6,901,708 | B1 | * | 6/2005 | Powers, III | 52/91.1 |
| 8,677,708 | B2 | | 3/2014 | Williams | |

* cited by examiner

*Primary Examiner* — Basil Katcheves
(74) *Attorney, Agent, or Firm* — Buskop Law Group, PC; Wendy Buskop

(57) ABSTRACT

A building having metal roof center sections with integral roof panel folded flanges and when connected together the folded flanges form metal rafter with an I-beam configuration. The building having at least one metal roof end section with an integral folded flange that when fastened to a main roof folded flange, forms a rafter with the I-beam configuration. The building having a plurality of one piece metal wall central panels each having a pair of integral wall panel folded flanges extending down opposite sides of the one piece metal wall central panel, and when joined together, form a metal wall panel stud, and a plurality of one piece metal corner panels having integral corner panel folded flanges that form a metal stud when connected to another folded flange, form a skid mountable building.

7 Claims, 11 Drawing Sheets

WALL, ROOF AND BUILDING STRUCTURES

FIELD

The present embodiments generally relate to wall, roof and building structures. The structures of the present invention are useful in applications where a high degree of fire retardant performance is desirable or required as well as portability for the formed building.

BACKGROUND

A need exists for a fire resistant building.

A further need exists for an easy to move metal portable building with a roof vent for venting air into the building and modular construction to change size easily.

The present embodiments meet these needs.

BRIEF DESCRIPTION OF THE DRAWINGS

The detailed description will be better understood in conjunction with the accompanying drawings as follows.

Figure 1:
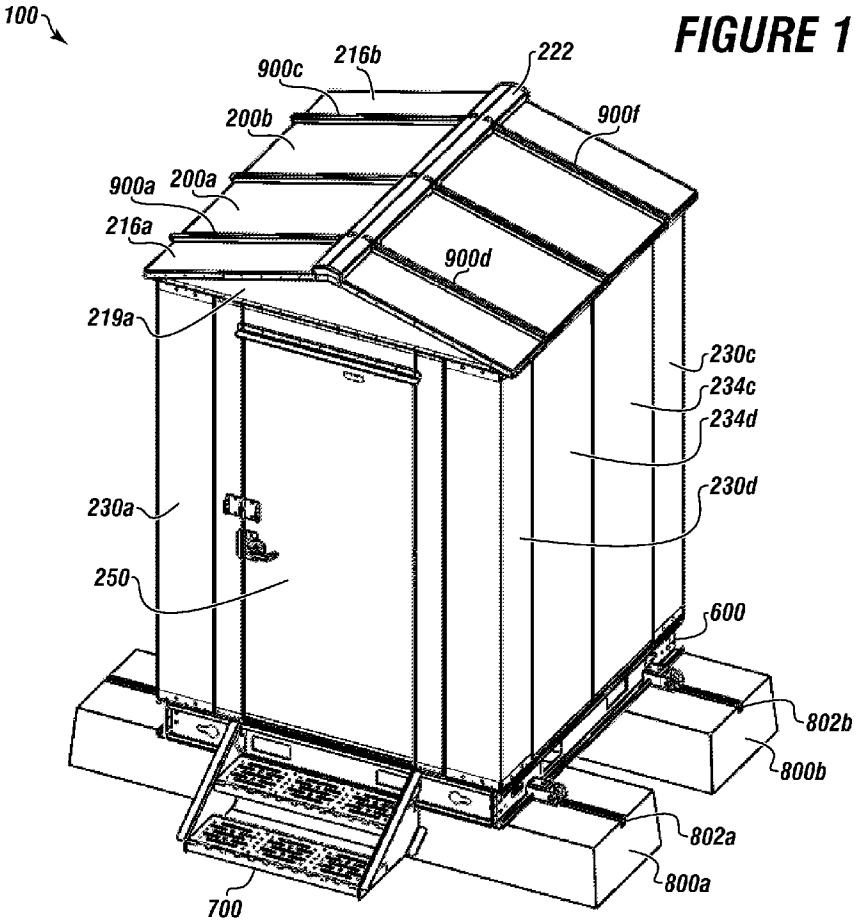
FIG. 1 depicts a building formed according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

In an embodiment of the invention, a metal wall structure can include a one piece metal central panel with two integral folded metal flanges and two one piece metal corner panels each corner panel with a single integral folded flange. When joined, the folded flanges of the wall panels can form a stud. Fasteners can join the folded flanges together. Multiple wall structures can be joined to form the walls of a building.

The building can include first and second wall structures.

In another embodiment of the invention, a metal roof structure can include a one piece metal central roof panel, with two integral folded metal flanges and two one piece metal side roof panels, each side roof panel with a single integral folded flange. When jointed, the folded flanges of the roof panels can form a rafter. Fasteners can join the folded flanges together. Multiple roof structures can be jointed to form the roof of the building with the multiple wall structures.

Reinforcing gussets can be used to secure the corner panels.

A roof vent can be formed in the roof structure.

A door can be inserted in place of one or two of the wall panels creating an easy ingress or egress to the building.

The building can be constructed over a concrete foundation or a specialized movable skid.

The building can be positioned over uniquely created cement blocks for safety from rising water.

The following definitions are used herein.

The term "door" as used herein can refer to a conventional door to the building but also a closable opening, such as a watertight hatch.

The term "double folded flanges" as used herein can refer to two bends in the metal of the panels forming a C-shape or D-shape along an edge. Each bend can be a 90 degree bend back towards the center line of a panel.

The term "fasteners" as used herein can refer to rivets or bolts.

The term "filleted" as used herein can refer to corners that are cut to a rounded edge.

The term "galvanneal" as used herein can refer to the combined process of galvanizing and annealing to produce specialized sheets of steel. The galvanization is made through the hot-dipping process and an immediate in-line annealing and gives a very fine greyish matte finish. Galvanneal does not flake off its galvanized coating when formed, stamped, and bent. The very fine matte finish acts like a primer, allowing paint to adhere easily, and is very rust proof; only white to dark grey marks appear if it comes in contact with water. Galvanneal sheets offer good paintability, weldability, corrosion resistance, and formability.

The term "utility slots" as used herein can refer to slots in the sides of the skid which can function as tie down slots, or function as lifting slots for lifting the building with a hoist, or dragging slots for pulling the building with a chain and a tractor, or holding slots for securing the building to a flatbed truck or to a train so the building does not fall off the vehicle.

The building has an all metal construction for fire resistance in the case of an adjacent burning building.

The building, in embodiments, will survive at least 3 feet of snow on the roof, providing a strong building for shelter in the event of a destructive blizzard.

The building as designed will survive a force 5 hurricane when secured to a skid with ballast blocks or a concrete foundation.

The building can be quickly moved to a site of a natural disaster and set in place in less than 1 hour, and serve as a triage location for victims of a mudslide or tornado stricken area.

The building can have a door with a lever style lockset which enables easy exit from the building for an injured person in the building, such as someone with a broken arm or burnt hands.

The building is cheap to move, with easy forklift access points for lifting of the entire building when the building is mounted to a skid.

In embodiments, the building is prefabricated before delivery to the user, allowing the building to be more finished than a quickly erected building from a kit delivered to a home improvement store.

The inventive portable, modular building can have metal roof center sections with integral roof panel folded flanges and when connected together the folded flanges form metal rafter with an I-beam configuration.

Additionally the roof of the building can have at least one metal roof end section with an integral folded flange that when fastened to a main roof folded flange forms a rafter with an I-beam configuration.

The building, which can be deployed as an emergency shelter after a hurricane, can be skid mounted in embodiments with a plurality of one piece metal wall central panels each having a pair of integral wall panel folded flanges extending down opposite sides of the one piece metal wall central panel, and when joined together, form metal wall panel studs.

The building, which can have a door, stairs, a lockset on the door, and a roof vent, can have a plurality of one piece metal corner panels, each with integral corner panel folded flanges that form a metal stud when connected to another folded flange.

Turning now to the Figures, FIG. 1 depicts a building formed according to one or more embodiments.

The building 100 is shown with the unique roof structure mounted to a skid 600.

The roof structure can be made from multiple metal roof center sections 200*a* and 200*b* connected together forming a roof ridge and rafters. The metal roof center sections can have a triangular shape or a pyramid-like shape.

The roof structure can be made from multiple metal roof end sections 216*a* and 216*b*.

Each metal roof end section can be connected to a metal roof center section.

Each metal roof end section can have a triangular shape or a pyramid-like shape. Each metal roof end section can have a roof face 219*a* for keeping water out of the formed building.

A roof cap 222 can be over a formed roof ridge created by joining folded flanges of the metal roof center sections together. The building can also include a roof vent with holes allowing air to enter and exit the building while preventing bugs from entering the building.

The building 100 can include a plurality of one piece metal corner panels 230*a*, 230*c* and 230*d*. Each one piece metal corner panel can be connected to one of the metal roof end sections.

The building 100 can include a plurality of one piece metal wall central panels 234*c* and 234*d* joined together connecting between one piece metal corner panels.

The building 100 can have a door 250 mounted between two of the one piece metal corner panels. In embodiments, the door 250 can be mounted between two of the one piece metal wall central panels or between one of the one piece metal wall central panels and one of the one piece metal corner panels.

The building 100 can include a stair assembly 700. The stair assembly is shown with two foot treads. One or more foot treads can be used within the scope of the invention.

Ballast blocks 800*a* and 800*b* can be used for supporting the skid 600. Each ballast block can be formed from a cast Portland concrete. Each ballast block 800*a* and 800*b* can have a strut channel 802*a* and 802*b* respectively. In embodiments, a plurality of ballast block forklift slots can be formed in each ballast block. In embodiments, each ballast block forklift slot can be perpendicular to each strut channel. In embodiments, rebar can be installed in each ballast block.

A rafter can be formed where each metal roof center section or metal roof end section connects to an adjacent metal roof center section or metal roof end section. Rafter covers 900*a*-900*f* can be placed over each rafter.

Figure 2:
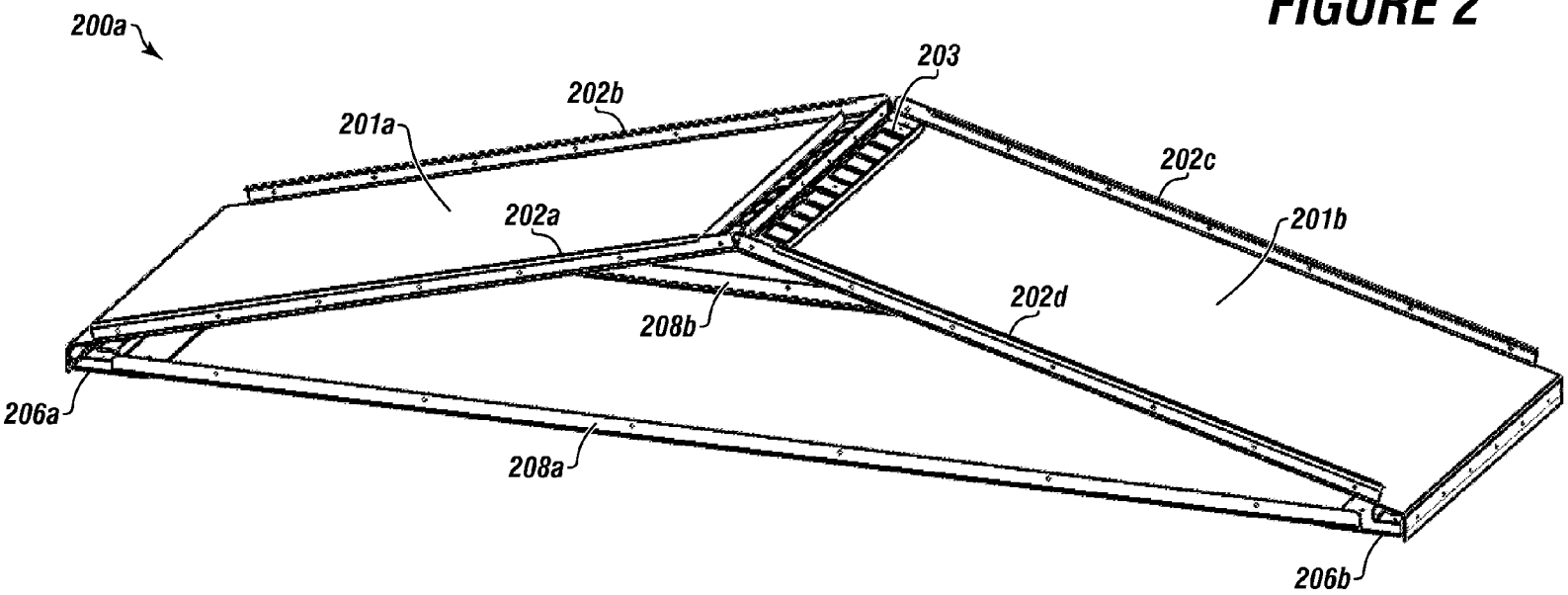
FIG. 2 depicts a metal roof center section according to one or more embodiments.

FIG. 2 depicts a metal roof center section according to one or more embodiments.

The metal roof center section 200*a* can have a first one piece main roof panel 201*a* and a second one piece main roof panel 201*b* joined to the first one piece main roof panel.

In this embodiment, both one piece main roof panels can be identical in size, shape, and thickness. In other embodiments both one piece main roof panels can be different in size, shape, and thickness. The one piece main roof panels can be made of metal.

The first one piece main roof panel 201*a* can have a first integral roof panel folded flange 202*a* and a second integral roof panel folded flange 202*b* folded up from the side having two bends, such as in a C-shape. The integral roof panel folded flanges can be on opposite sides of the first one piece main roof panel.

The second one piece main roof panel 201*b* can have a first integral roof panel folded flange 202*c* and a second roof panel folded flange 202*d* folded up from the side having two bends, such as in a C-shape. The integral roof panel folded flanges can be on opposite sides of the second one piece main roof panel.

A plurality of vent holes 203 can be formed in each one piece main roof panel on the ends which are joined together.

Each metal roof center section can have a first soffit 206*a* connected to the first one piece main roof panel and a second soffit 206*b* connected to the second one piece main roof panel.

A first joist 208*a* can connect to one end of the first soffit and one end of the second soffit.

A second joist 208*b* can connect to one end of the first soffit and one end of the second soffit on ends opposite the first joist, ensuring that the first joist is parallel to the second joist.

Figure 3:
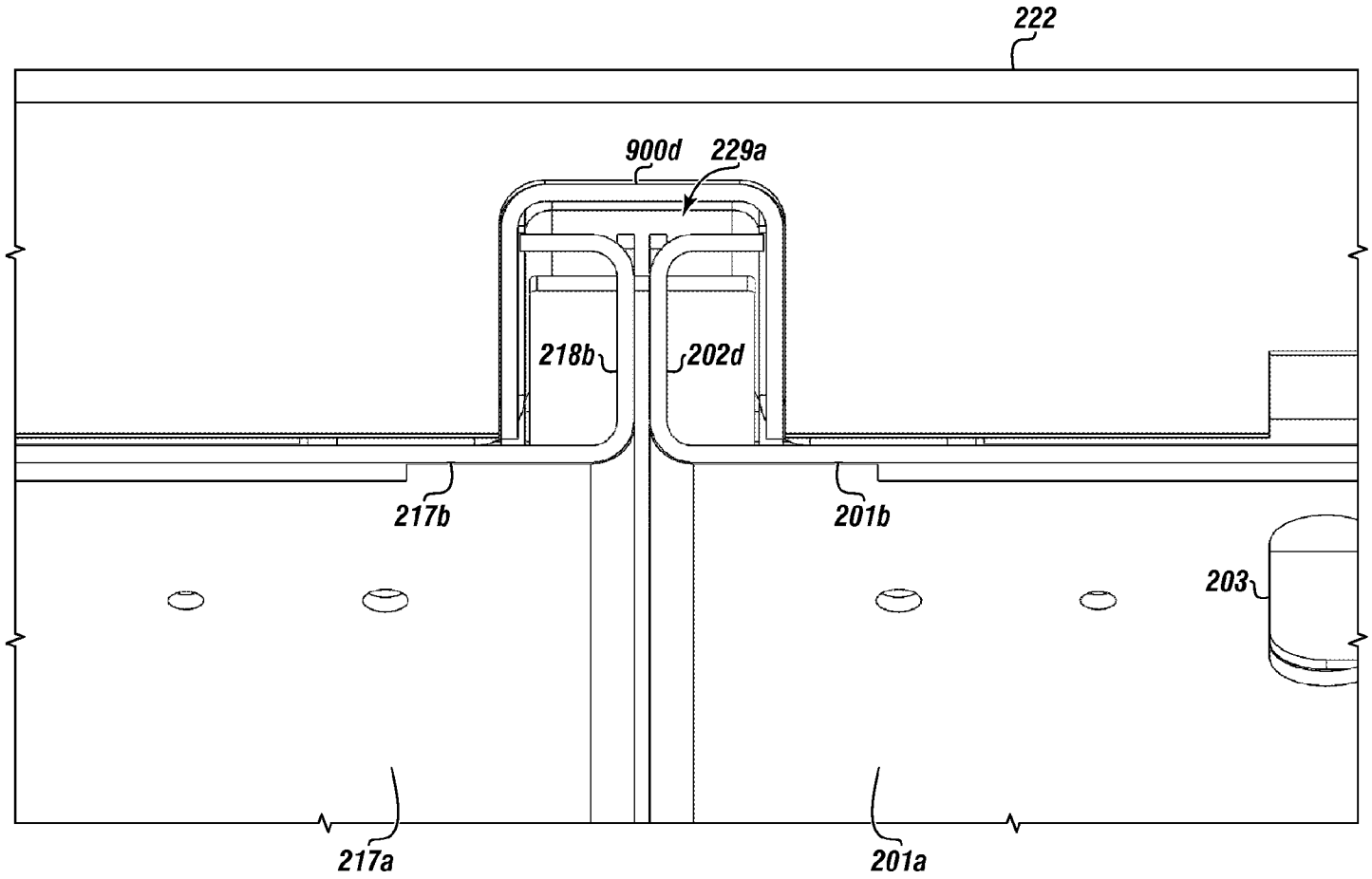
FIG. 3 depicts a detail of an integral roof end panel folded flange joined to an integral roof panel folded flange according to one or more embodiments.

FIG. 3 depicts a detail of an integral roof end panel folded flange joined to an integral roof panel folded flange according to one or more embodiments.

A roof cap 222 can be over the joined sections.

The roof panels can have a plurality of vent holes. Vent hole 203 is shown formed through the roof panel.

When the integral roof panel folded flanges of adjacent one piece main roof panels are connected together, a metal rafter 229*a* having an I-beam configuration can be formed.

An integral roof end panel folded flange 218*b* can be folded up from one side of a second one piece roof end panel 217*b*.

A portion of the integral roof end panel folded flange 218*b* is shown in parallel with a portion of a second integral roof panel folded flange 202*d* that is folded up with two bends from the first side of second one piece main roof panel 201*b*.

A rafter cover 900*d* is shown placed over the joined folded flanges that form the metal rafter 229*a*.

A first one piece roof end panel 217*a* and a first one piece main roof panel 201*a* are also shown.

Figure 4:
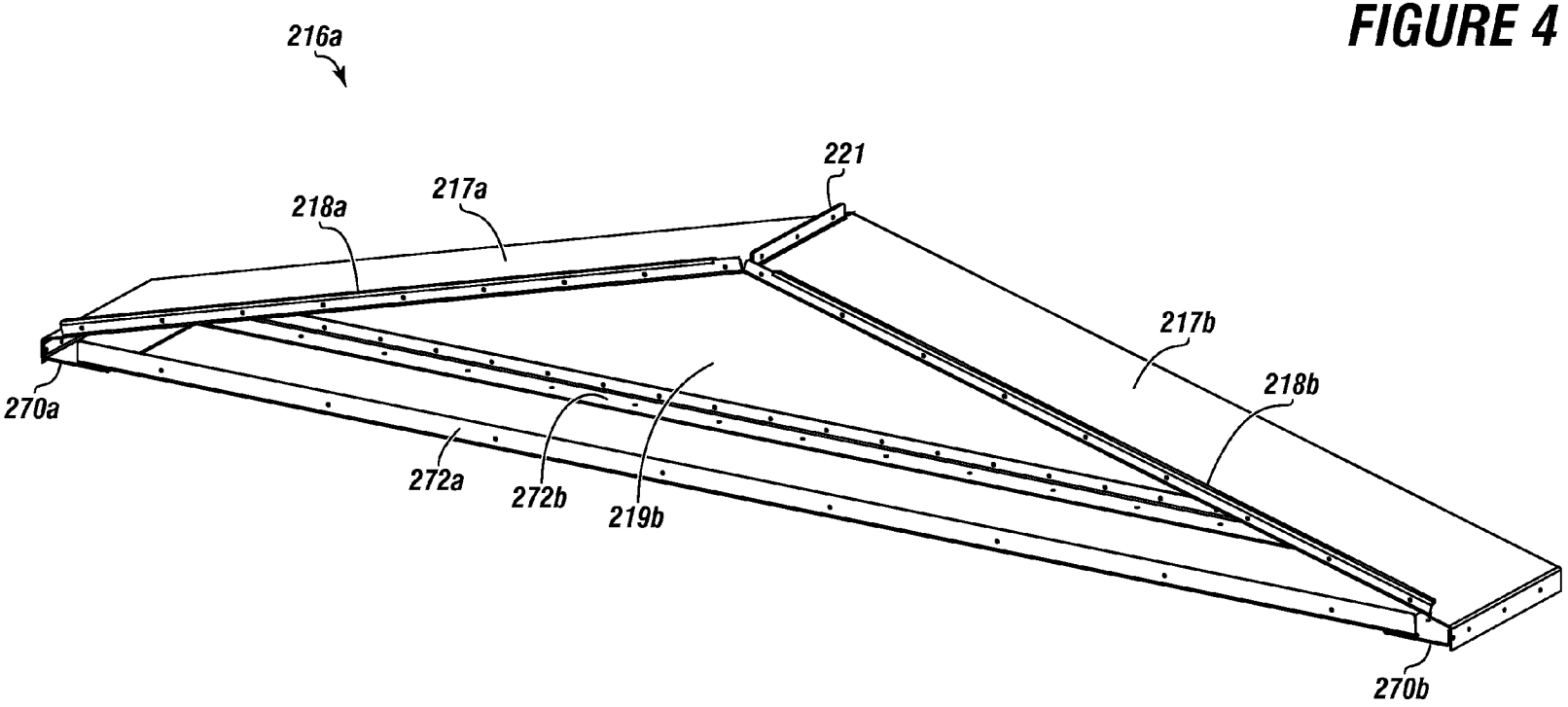
FIG. 4 depicts a metal roof end section according to one or more embodiments.

FIG. 4 depicts a metal roof end section according to one or more embodiments.

The metal roof end section can engage one of the one metal roof center sections. The metal roof end section can have a triangular shape.

The metal roof end section 216*a* can have a first one piece roof end panel 217*a*; a second one piece roof end panel 217*b*; an integral roof end panel folded flange 218*a* folded up from one side of the first one piece roof end panel 217*a*, and an integral roof end panel folded flange 218*b* folded up from one side of the second one piece roof end panel 217*b*.

Like with the one piece main roof panels, when the integral roof end panel folded flanges can be connected to an integral roof panel folded flange, a metal rafter having an I-beam configuration is formed.

A first end roof soffit 270*a* can be connected to the first end roof panel and a second end roof soffit 270*b* can be connected to the second end roof panel.

A first end roof joist 272*a* can be connected between the first end roof soffit and the second end roof soffit.

A second end roof joist 272*b* can be connected between the first end roof soffit and the second end roof soffit.

The first end roof joist can be parallel to the second end roof joist.

When one of the one piece roof end panels is connected to a one piece main roof panel, a metal rafter can be formed when the integral roof end panel folded flange and integral roof panel folded flange are joined, forming a hurricane proof roof.

A roof ridge 221 is shown formed where the first one piece roof end panel and second one piece roof end panel meet.

A roof face 219*a* is also shown for keeping out the water and particulate from the interior of the formed building.

Figure 5:
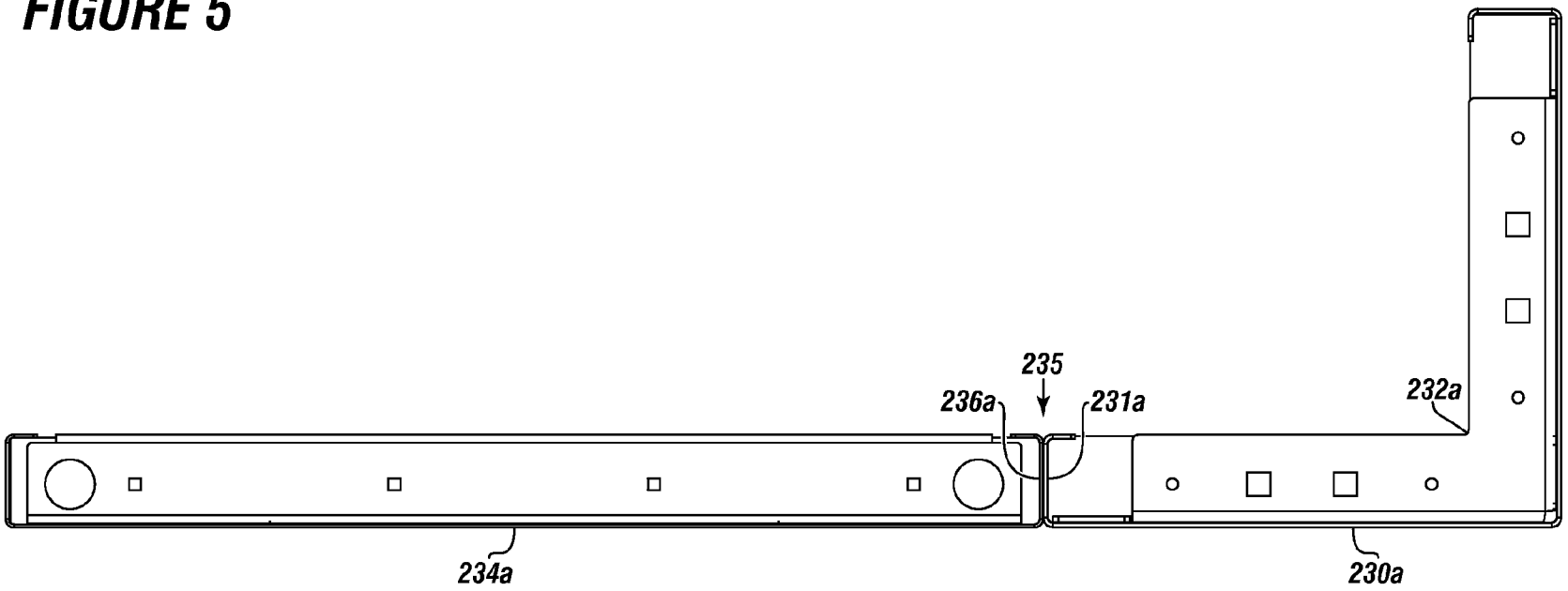
FIG. 5 depicts a top view of a one piece metal corner panel connected to a one piece metal wall central panel according to one or more embodiments.

FIG. 5 depicts a top view of a one piece metal corner panel connected to a one piece metal wall central panel according to one or more embodiments.

The one piece metal corner panel 230*a* can have an integral corner panel folded flange 231*a* which is C-shaped and integral to the metal corner panel section.

A gusset 232*a* having an L-shape and made from ⅛ inch to ¼ inch metal can be disposed over the corner panel to provide additional ruggedness in the face of hurricanes.

The integral corner panel folded flange, when joined together with an integral wall panel folded flange 236*a* of a C-shape integral with a one piece metal wall central panel 234*a* can form a stud 235 between the corner panel and the metal wall central panel.

Figure 6:
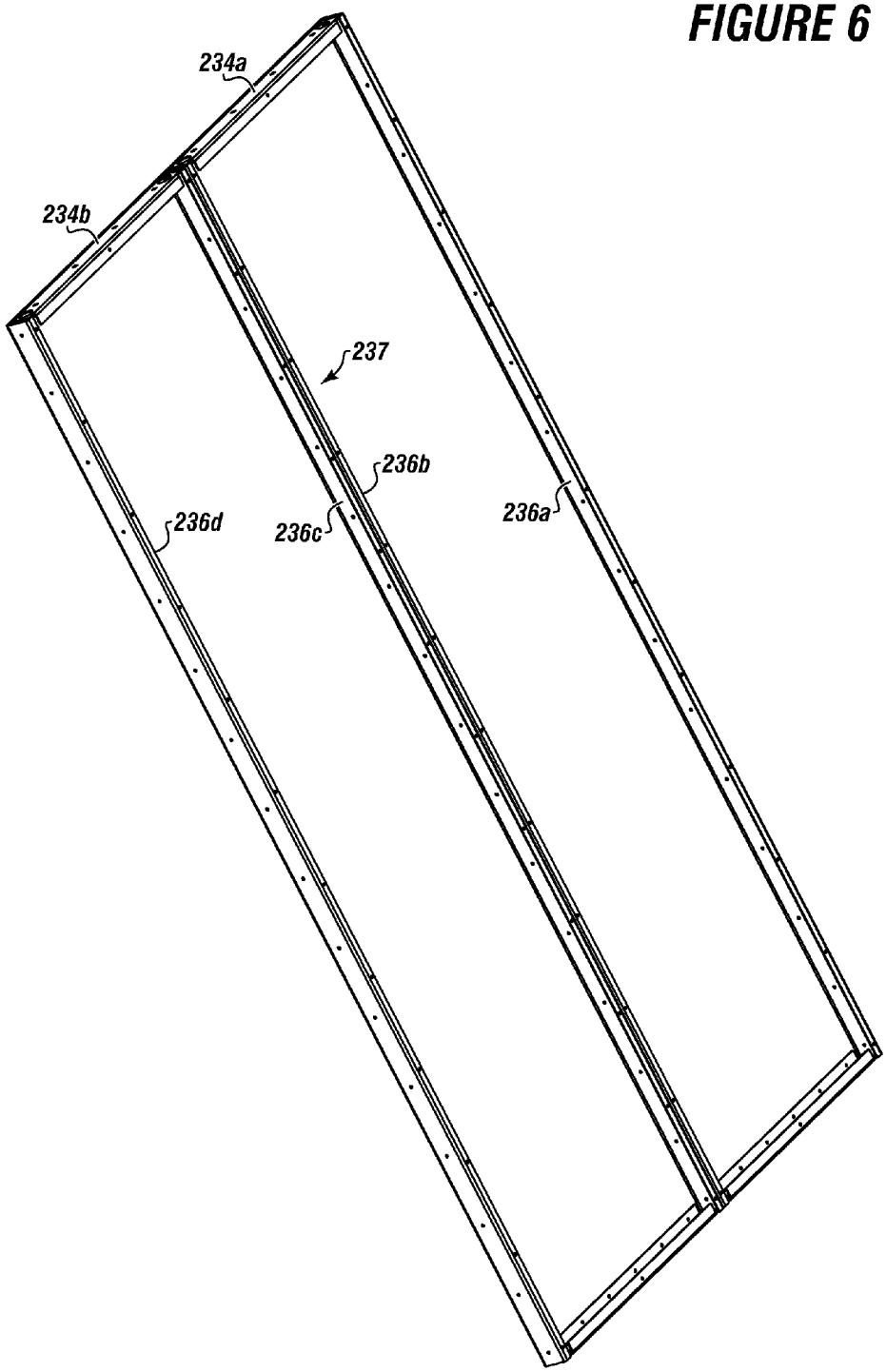
FIG. 6 depicts a pair of one piece metal wall central panels joined together according to one or more embodiments.

FIG. 6 depicts a pair of one piece metal wall central panels joined together according to one or more embodiments.

The one piece metal wall central panels 234*a* and 234*b* can each have a pair of integral wall panel folded flanges. One piece metal wall central panel 234*a* is shown with integral wall panel folded flanges 236*a* and 236*b*. One piece metal wall central panel 234*b* is shown with integral wall panel folded flanges 236*c* and 236*d*.

Each integral wall panel folded flange can extend down an opposite side of each one piece metal wall central panel. When the integral wall panel folded flanges are joined together, a metal wall panel stud 237 can be formed between the one piece metal wall central panels 234*a* and 234*b*.

Figure 7:
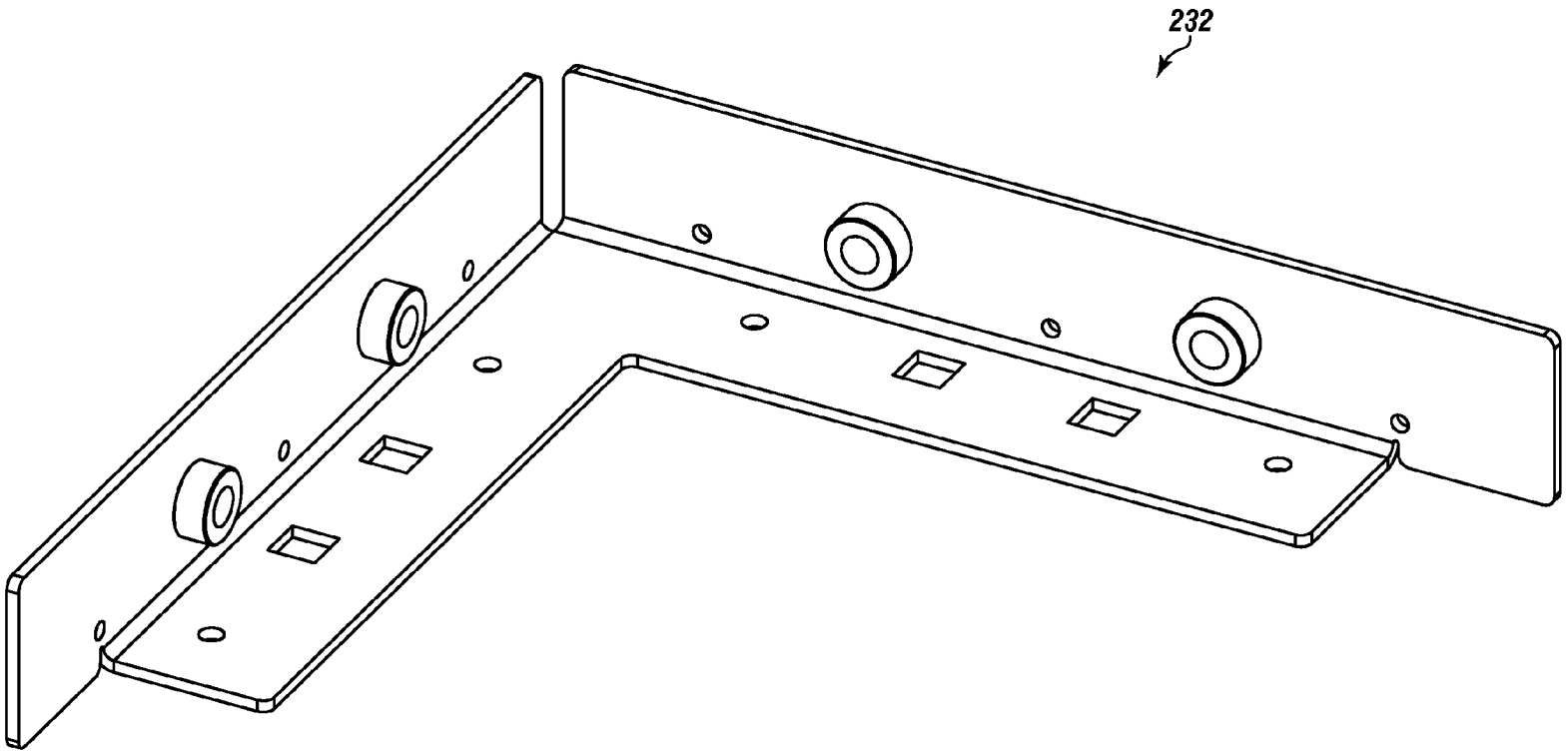
FIG. 7 depicts one of a plurality of gussets usable with the building according to one or more embodiments.

FIG. 7 depicts one of a plurality of gussets usable with the building according to one or more embodiments.

Each gusset 232 can be L-shaped. Each gusset can be made from a metal plate having a length from 3 inches to 6 inches, a width from ¼ inch to 1 inch, and a thickness from 1/16 inch to 1½ inches. Each gusset can be attached to each one of the one piece metal corner panels.

Figure 8:
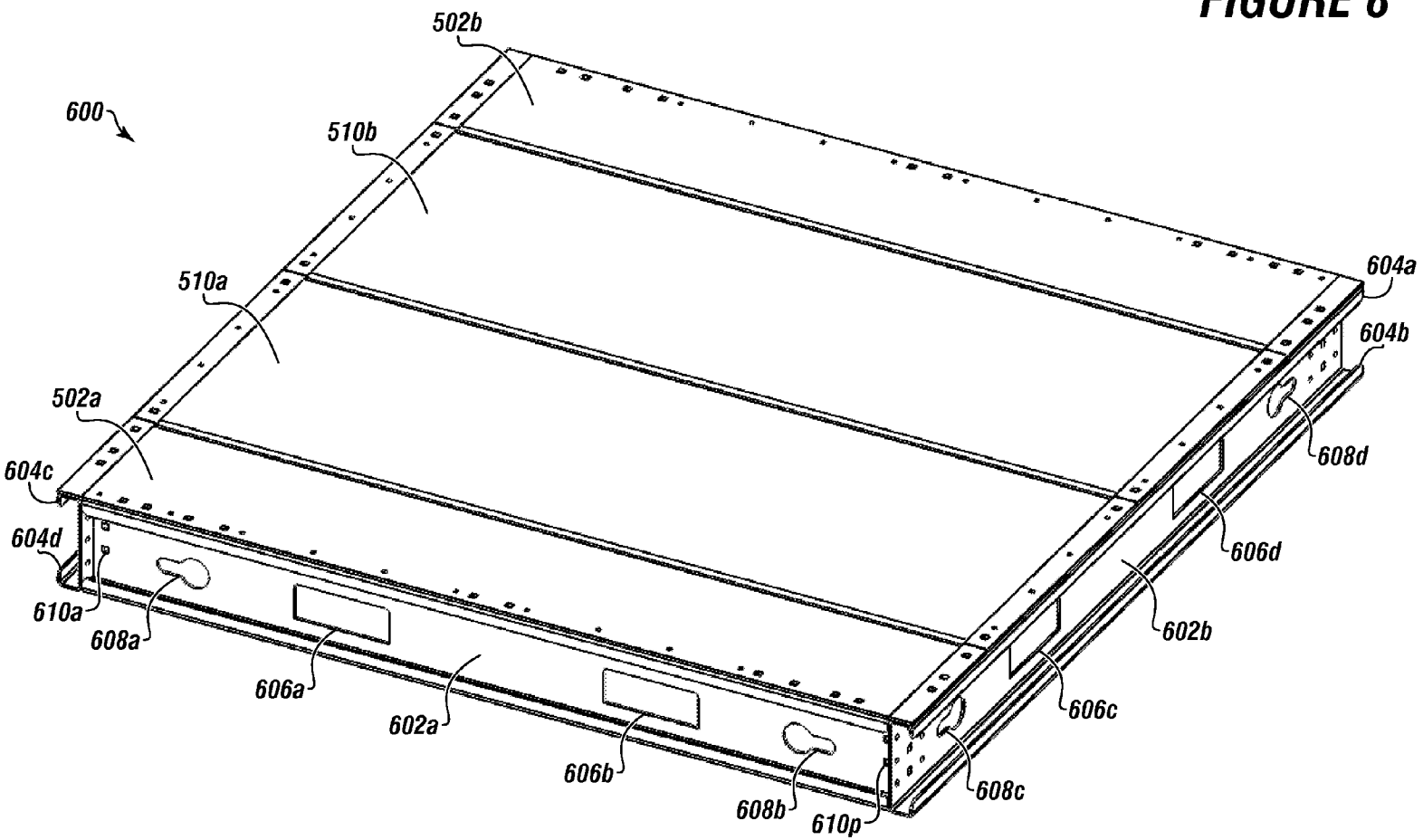
FIG. 8 depicts a skid usable with the building according to one or more embodiments.

FIG. 8 depicts a skid usable with the building according to one or more embodiments.

In embodiments, the building can be affixed over a skid 600.

The skid can have four skid rails. Skid rails 602*a* and 602*b* are shown.

Each skid rail can have a skid double return 604*a*-604*d* having a C-shape with two bends in the metal from the side of the skid rail.

Each skid rail can have a plurality of skid forklift slots 606*a*-606*d* in each side.

Each skid rail can have a plurality of tie down holes 608*a*-608*d* for securing the skid to a transport vessel.

Each skid rail can have a plurality of fastening holes 610*a*-610*p* allowing each skid to secure to another skid, extending the total combined skid dimension.

The skid forklift slots can allow the entire building to be lifted by a forklift from any side at any time.

A pair of end floor panels 502*a* and 502*b* can be connected to a plurality of center floor panels 510*a* and 510*b* that can also be connected to each other. The end floor panels and center floor panels can be mounted to the skid forming a floor over the skid for use in the building.

Figure 9:
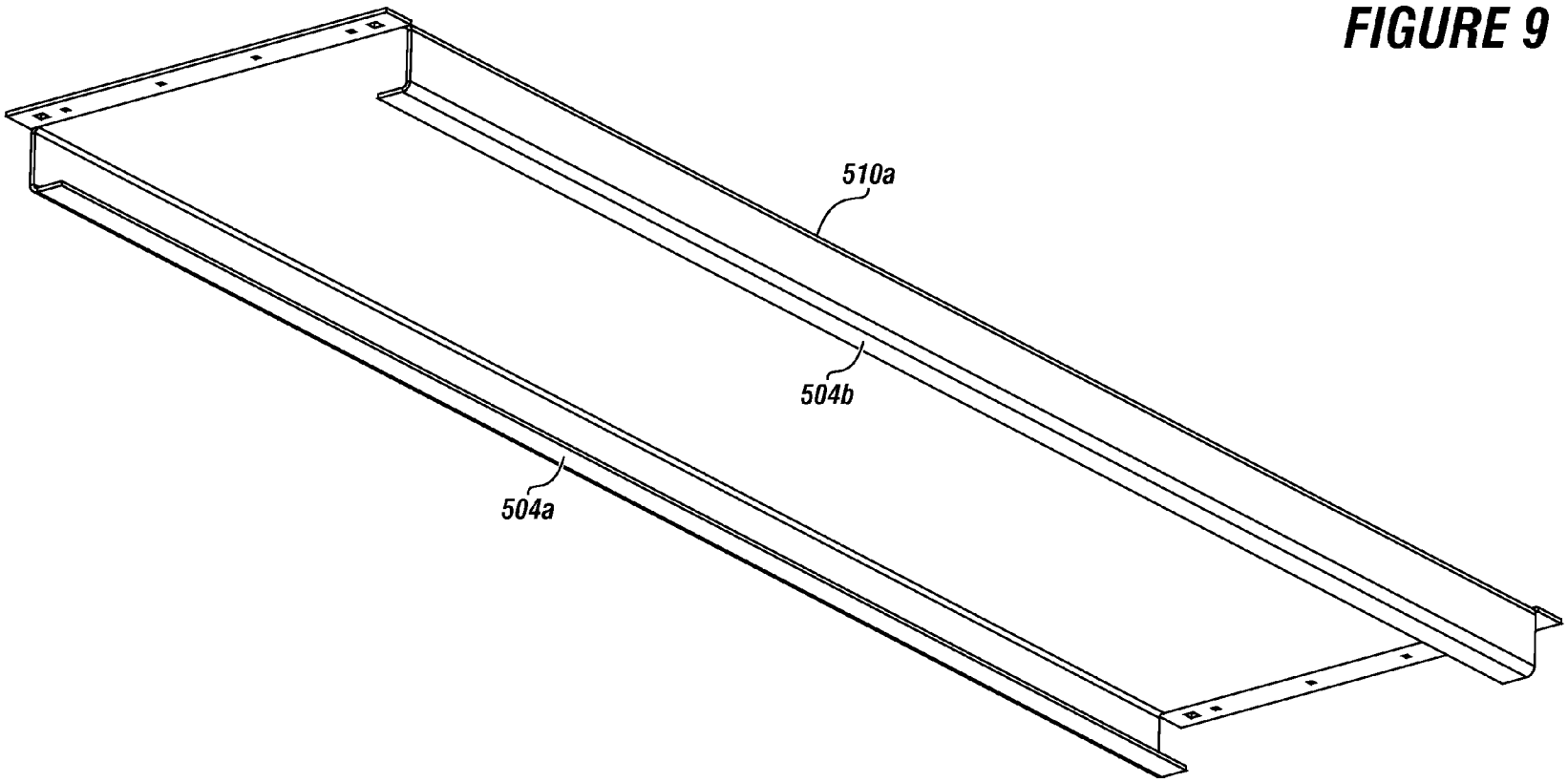
FIG. 9 depicts a center floor panel with a double return folded flange according to one or more embodiments.

FIG. 9 depicts a center floor panel with a double return folded flange according to one or more embodiments.

The center floor panel 510*a* can have a pair of center floor panel double return folded flanges 504*a* and 504*b* extending longitudinally along opposite sides of the center floor panel. The center floor panel double return folded flanges can be fastened to an end floor panel double return folded flange, forming a strong beam. The end floor panels and center floor panels can all engage the skid.

Figure 10:
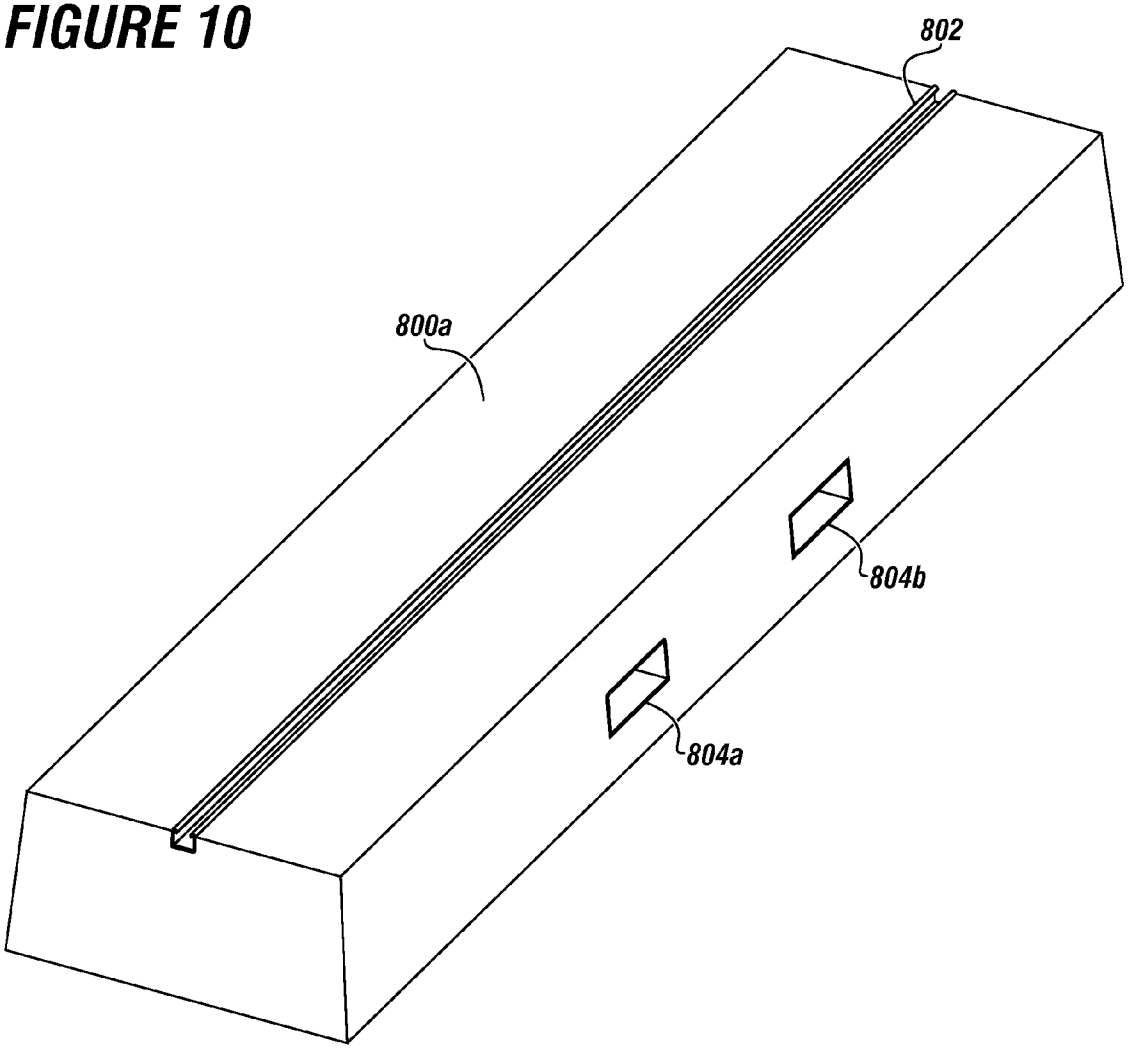
FIG. 10 depicts a ballast block usable with the building according to one or more embodiments.

FIG. 10 depicts a ballast block usable with the building according to one or more embodiments.

The ballast block 800*a* can have a strut channel 802 and a plurality of ballast block forklift slots 804*a* and 804*b* formed perpendicular to the strut channel. The ballast block can be beneath the skid for supporting the building. Two ballast block can be used to support the skid.

The ballast block can be a cast concrete ballast block.

Figure 11:
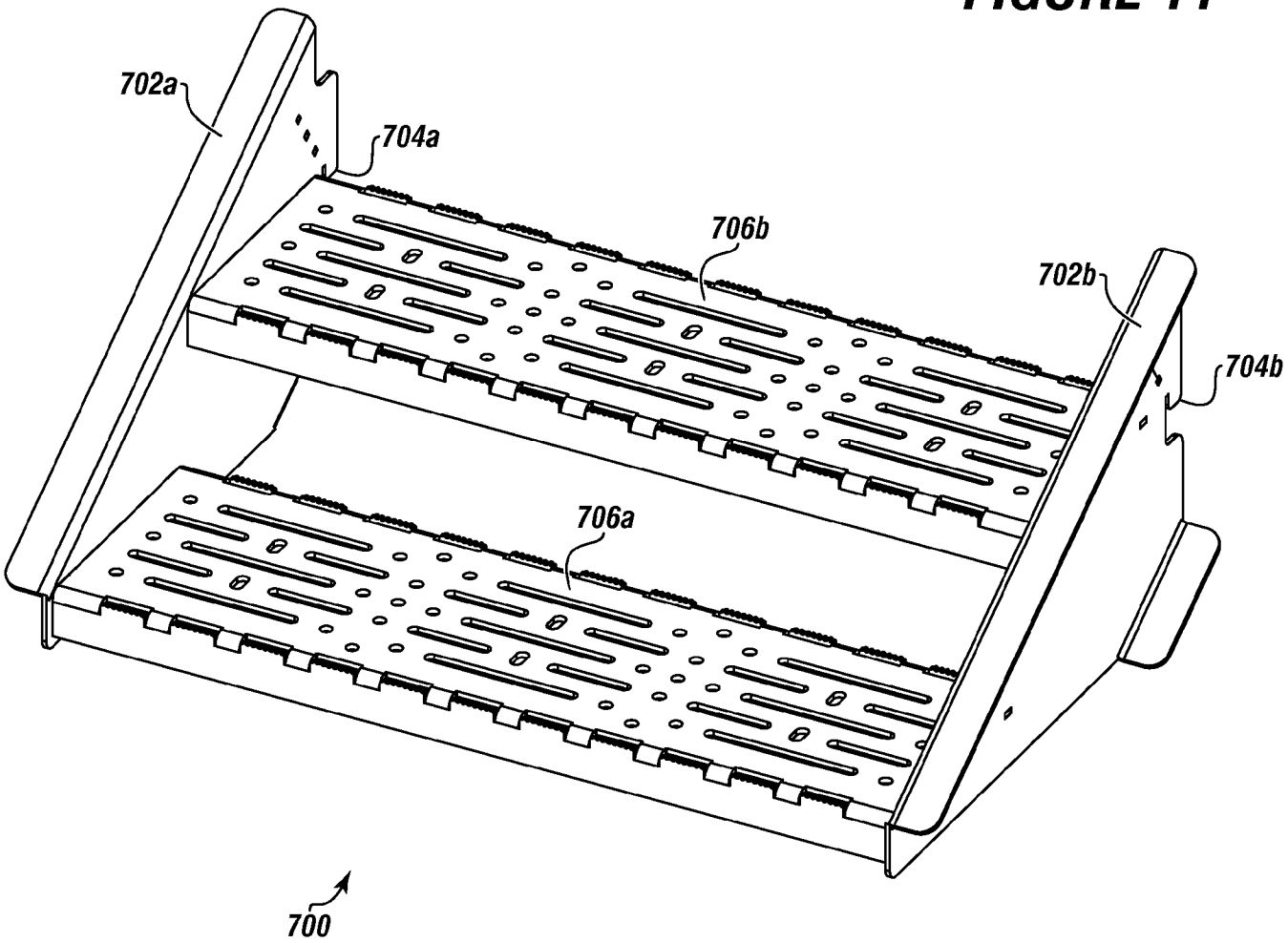
FIG. 11 depicts the stair assembly according to one or more embodiments.

FIG. 11 depicts the stair assembly according to one or more embodiments.

The stair assembly 700 can be constructed using a first stringer 702*a* with a first interlock mechanism 704*a* and a second stringer 702*b* with a second interlock mechanism 704*b*. The stair assembly can include a plurality of foot treads 706*a* and 706*b* mounted between the stringers. The first and second interlock mechanisms can engage one of the skid double returns.

In embodiments, galvannealed sheet metal can be used for the roof panels, the wall panels, and the floor panels.

In embodiments, a lever style lockset can be used for the door.

In embodiments, all exposed corners of the building, panels, floor and skid can be filleted.

In embodiments, a bug screen can be mounted over the vent holes of the central roof panels and a bug screen retainer can be mounted over the bug screen and roof ridge.

While these embodiments have been described with emphasis on the embodiments, it should be understood that within the scope of the appended claims, the embodiments might be practiced other than as specifically described herein.

What is claimed is:

1. A building comprising:

a. at least one metal roof center section comprising:

(i) a first one piece main roof panel;

(ii) a second one piece main roof panel joined to the first one piece main roof panel;

(iii) a plurality of vent holes formed in each one piece main roof panel;

(iv) an integral roof panel folded flange folded up from each side of each one piece main roof panel; and when the integral roof panel folded flanges of adjacent one piece main roof panels connect together, a metal rafter with an I-beam configuration is formed;

b. at least one metal roof end section comprising:

(i) a first one piece roof end panel;

(ii) a second one piece roof end panel;

(iii) a first integral roof end panel folded flange folded up from one side of the first one piece roof end panel;

(iv) a second integral roof end panel folded flange folded up from one side of the second one piece roof end panel; and when one of the integral roof end panel folded flanges and an adjacent integral roof panel folded flange are connected together, a metal end rafter with an I-beam configuration is formed;

c. a plurality of one piece metal wall central panels for fitting between a plurality of one piece metal corner panels having a pair of integral wall panel folded flanges extending down opposite sides of the one piece metal wall central panel, and when the integral wall panel folded flanges are joined together, a metal wall panel stud is formed between the one piece metal wall central panels;

d. the plurality of one piece metal corner panels, each one piece metal corner panel connected to one of the metal roof end sections, each one piece metal corner panel having integral corner panel folded flanges, and when the integral corner panel folded flange is connected to a one piece metal wall central panel folded flange, a stud is created between the one piece metal corner panel and the one piece metal wall central panel;

e. a plurality of gussets, each gusset attached to each of the one piece metal corner panels;

f. a door mounted between two of the one piece metal corner panels, between two of the one piece metal wall central wall panels, or between one of the one piece metal wall central wall panels and one of the one piece metal corner panels; and g. a skid, wherein the skid comprises: skid rails formed on each side of the skid, each skid rail having a skid double return; a plurality of skid forklift slots formed through each side; a plurality of fastening holes mounted to opposing ends of opposing sides of the skid for extending the skid allowing the area of the building to be increased; and wherein the skid forklift slots allow the entire building to be lifted by a forklift.

2. The building of claim 1, each roof section further comprises:

a. a first soffit connected to the first one piece main roof panel;

b. a second soffit connected to the second one piece main roof panel;

c. a first joist connected to one end of the first soffit and one end of the second soffit; and d. a second joist connected to one end of the first soffit and one end of the second soffit on ends opposite the first joist, wherein the first joist is parallel to the second joist.

3. The building of claim 2, wherein the assembled roof comprises a roof cap mounted over a roof ridge.

4. The building of claim 1, wherein the one piece main roof panels, one piece roof end panels, the one piece metal wall central panels, and the one piece metal corner panels are comprised of galvannealed sheet metal.

5. The building of claim 1, comprising:

a. a pair of end floor panels, each end floor panel having an end floor panel double return folded flange extending longitudinally along one side of the end floor panel; and b. a plurality of center floor panels mounted between the end floor panels, each center floor panel having a pair of parallel center floor panel double return folded flanges, wherein the center floor panel double return folded flanges are fastened to one of the end floor panel double return folded flanges or one of the center floor panel double return folded flanges, and wherein the end floor panels and center floor panels engage the skid.

6. The building of claim 1, further comprising a stair assembly, the stair assembly comprising:

a. a first stringer with a first interlock mechanism;

b. a second stringer with a second interlock mechanism; and c. at least one foot tread mounted between the first and second stringers; and wherein the first interlock mechanism and the second interlock mechanism engage one of the skid double returns.

7. The building of claim 1, further comprising at least a pair of ballast blocks for supporting the skid, wherein each ballast block is formed comprising:

a. a strut channel; and b. a plurality of ballast block forklift slots formed perpendicular to the strut channel.

* * * * *